US006565110B1

(12) United States Patent
Holzer

(10) Patent No.: US 6,565,110 B1
(45) Date of Patent: May 20, 2003

(54) MOUNTING PLATE FOR A COUPLING MECHANISM ON A RUNNER

(75) Inventor: Helmut Holzer, Wagrain (AT)

(73) Assignee: Atomic Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 09/687,871

(22) Filed: Oct. 13, 2000

(30) Foreign Application Priority Data

Oct. 22, 1999 (AT) ..... 737/99 U

(51) Int. Cl.[7] ..... A63C 9/00
(52) U.S. Cl. ..... 280/607; 280/611
(58) Field of Search ..... 280/600, 611, 280/617, 623, 14.21, 14.22, 601, 607; D21/761; 441/70

(56) References Cited

U.S. PATENT DOCUMENTS 3,917,298 A 11/1975 Haff ..... 280/607

FOREIGN PATENT DOCUMENTS

| | | |
|---|---|---|
| AT | 372 614 | 10/1983 |
| AT | 396 749 | 11/1993 |
| DE | 41 24 965 | 2/1992 |

*Primary Examiner*—Paul N. Dickson
*Assistant Examiner*—Laura B. Rosey
(74) *Attorney, Agent, or Firm*—Collard & Roe, P.C.

(57) ABSTRACT

The invention describes a mounting plate (1) for a runner (2), in particular a ski (3), with a mounting surface (5) for a coupling mechanism, in particular a ski binding. The mounting plate (1) has fixing mechanisms (14) arranged in a longitudinal direction spaced at a distance apart, the mounting surface (5) extending across an entire mounting region for the coupling mechanism. Inset recesses (25) with insert elements (39) are provided in the mounting surface (5) in the region of the fixing mechanisms (14), extending from the longitudinal side faces (16, 17) of the mounting plate (1) in the direction of a longitudinal central axis (31).

20 Claims, 3 Drawing Sheets

MOUNTING PLATE FOR A COUPLING MECHANISM ON A RUNNER

BACKGROUND OF THE INVENTION

1. Field of the Invention

The invention relates to a mounting plate for a runner, having a mounting surface for a coupling mechanism, in particular a ski binding, for removably retaining a boot and having fixing mechanisms spaced at a distance apart from one another in the longitudinal direction of the mounting plate, and a runner, in particular a ski.

2. The Prior Art

A bearing element is known from DE 41 24 965 A1, which is arranged between the coupling components and the top face of a ski. It forms two receiving regions for the coupling components, spaced apart from one another in the longitudinal direction of the ski, and fulfils a damping function. Spacer elements are provided in bores running perpendicular to the top face of the ski, through which fixing elements extend and to which the coupling components on the ski are attached. The disadvantage of this design is that the clamping forces acting on the coupling elements are transmitted to the ski via the fixing elements, altering the bending characteristics thereof and adversely effecting damping behaviour due to the fact that the coupling components are supported on the top face of the ski by means of the spacer elements.

Also known from AT 396 749 B is a plate arranged on a top face of a ski for receiving a ski binding, which has another continuous plate-shaped damping element on which two plates are mounted, spaced at a distance apart, to receive the ski binding components. The bores for flxing, elements are surrounded by bevels for receiving the heads of the fixing elements, supported on the plates by means of ring-shaped damping elements in order to permit relative displacements. This design takes up relatively large surface regions which means that the fixing arrangement for the coupling components with the bearing plate has to be accurately matched, restricting the freedom of choice as to which coupling components may be used.

SUMMARY OF THE INVENTION

The underlying objective of the present invention is to provide a mounting plate, whereby the mounting surface is not adversely affected by recesses and fixing elements when attached to a runner, to which the coupling components or ski bindings can be directly attached and without fixing elements engaging in the runner, the final mounting of the coupling devices being simplified.

This objective is achieved in that the mounting surface extends across an entire mounting region for the coupling mechanism and inset recesses are provided in the region of the fixing mechanisms in the mounting surface, extending from longitudinal side faces of the mounting, plate in the direction of a longitudinal central axis. The surprising advantage of this arrangement is that it produces a standard-compliant mounting surface in terms of size and shape for attaching ski binding components or binding units, irrespective of the design of the top face of a runner. This allows a large amount of leeway in terms of the structural design of runners so that they can be adapted to a wide variety of and more specialised conditions of use and, this being the case, affording a free choice from the large rang e of coupling components ivailable. Mounting work is significantly simplified as a result because it is also possible to fit the runners with mounting plates of this type at the production stage, i.e. prior to delivery, so that the desired, selected ski binding can be mounted in a standard fitting process before handing over to the user. This rules out the possibility of errors inherent in faulty fixings and constituting a high safety risk.

It is also advantageous that the fixing systems used to attach the mounting plate to the runner are designed to provide longitudinal compensation for bending as a result of an arrangement incorporating fixed bearings and loose bearings, so that the clamping forces acting on the runner when the mounting plate is fitted do not affect its properties, as a result of which the inherent, structural properties predetermined for particular types or use, such as vibration behaviour and damping behaviour, etc., also remain unaffected.

The angled design of insert elements, which in certain cases serve as a means of anchoring fixing screws of the bindings, also have the effect of centring the insert elements relative to the centre point when bending forces are directed to the opposing ends of the runner due to flexing. This also increases friction surfaces between the inserts and the mounting plate, thereby preventing any unintended slipping, and any displacements of this nature are checked by the angled arrangement providing a secure seat for the insert elements in the mounting plate and hence the coupling components relative to the runner in all applications and situations.

Also of advantage is the matching design of the surface contour, e.g. the top face of the runner and the underside of the mounting plate, since this produces a positive mounting enabling high lateral forces to be transmitted without giving rise to increased shearing stress on the fixing elements.

It is also of advantage to use an intermediate section, enabling the standing height above a gliding surface of the runner to be varied without having to make mounting plates of varying thicknesses and mount them on bearings.

Another advantage is that the intermediate sections can be made from different materials in order to obtain different specific properties, e.g. damping action, to suit particular applications during use.

Also of advantage and falling within the scope of the invention is a runner, in particular a ski, where a mounting plate is attached to a top face of the runner in a mounting region for a coupling mechanism, e.g. for a ski binding, and the mounting plate is attached to the top face of the runner by means of an intermediate section, because they permit rapid, on the spot fitting and can be adapted to meet requirements within a large range of variability in terms of the combination of runner device and coupling device, avoiding faults during fitting.

BRIEF DESCRIPTION OF THE DRAWINGS

To provide a clearer understanding, the invention will be described in more detail below with reference to the embodiments illustrated in the appended drawings, wherein.

DETAILED DESCRIPTION OF PREFERRED EMBODIMENTS

Figure 1:
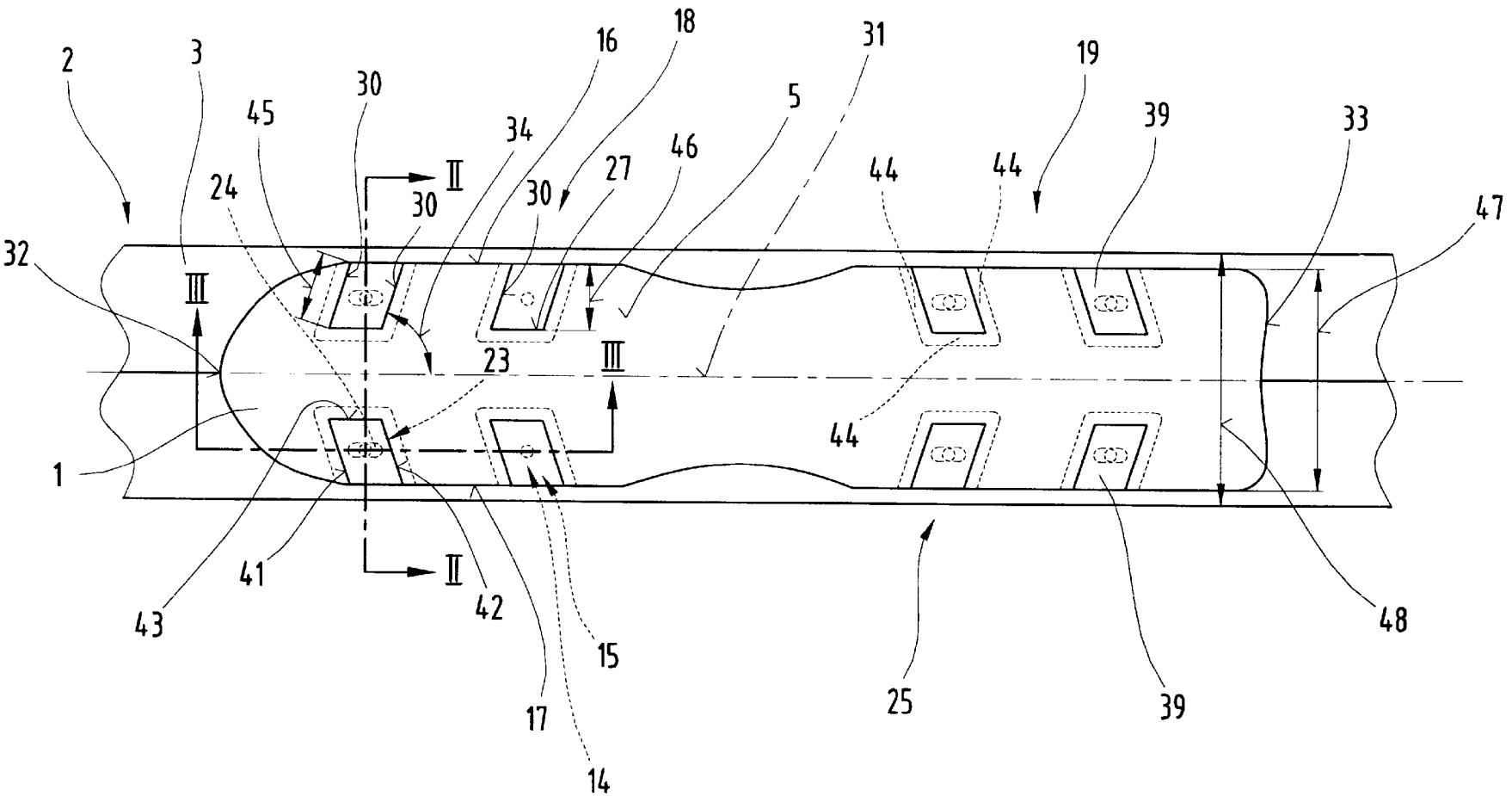
FIG. 1 illustrates a plan view of the mounting plate proposed by the invention.

Firstly, it should be pointed out that the same parts are shown by the same reference numbers and referred to by the same component names in the different embodiments described and the disclosures made throughout the description can be transposed in terms of meaning to the same parts bearing the same reference numbers and same component names. Likewise, the descriptions of positions, such as top, bottom, side, etc., relate to the drawing specifically being described and can be transposed in terms of meaning, when a new position is being described. Furthermore, individual features or combinations of features in the different embodiments described and illustrated can be construed as independent inventive solutions or solutions proposed by the invention in their own right.

Figure 2:
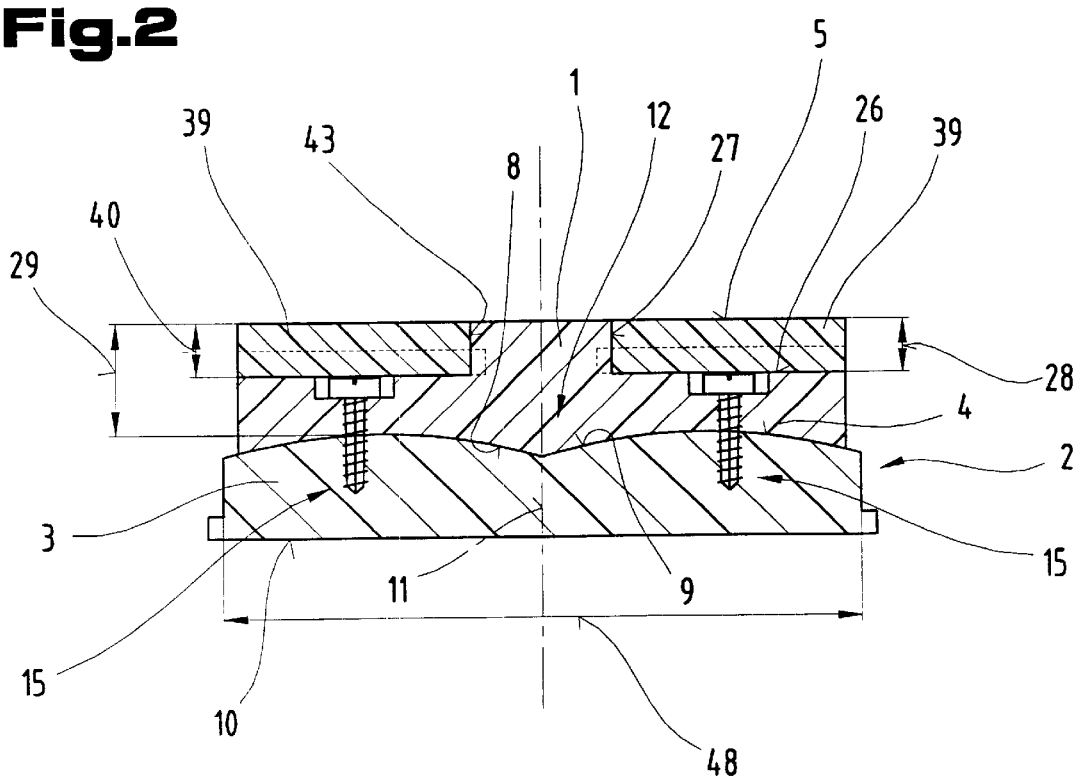
FIG. 2 shows the mounting plate proposed by the invention, seen in section along the lines II—II of FIG. 1.
Figure 3:
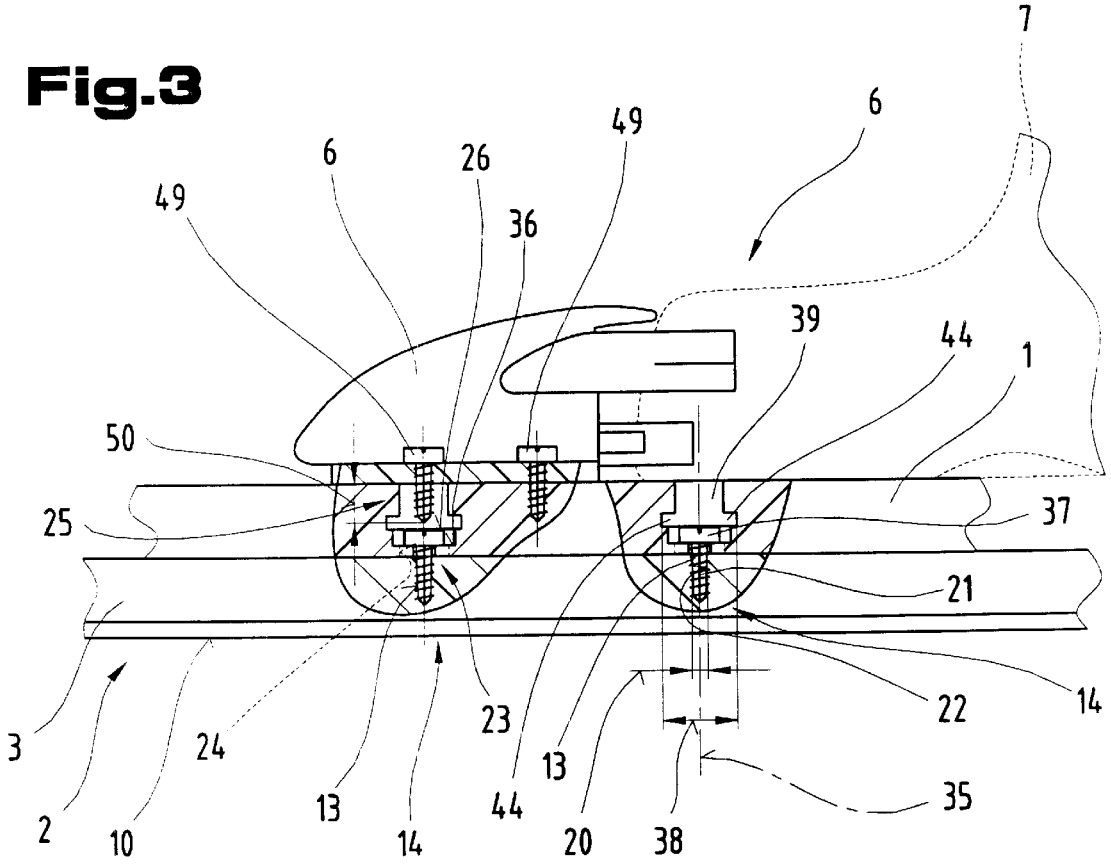
FIG. 3 shows the mounting plate from a front view, partially in section.

FIGS. 1 to 3 illustrate a mounting plate 1 proposed by the invention, irranged on a runner 2, in particular a ski 3.

Having a surface 4 remote from the ski 3, the mounting plate 1 forms a mounting surface 5 for supporting coupling components, e.g. of a ski binding 6, for retaining a boot 7. An underside 8 of the mounting plate facing the ski 3 is contoured to match a top face 9 of the ski 3, thereby providing a positive bearing. In the embodiment illustrated as an example here, the top face 9 of the ski 3 is provided with two cambered raised regions running parallel with one another in a longitudinal direction, forming a recess 12 in a longitudinal direction of the ski 3 and a longitudinal central plane 11 running perpendicular to a gliding surface 10 of the ski 3. The matching design of the underside 8 of the mounting plate 1 and the resultant positive fit produces a good transfer of forces with regard to the control forces transmitted onto the ski 3 via the ski binding 6 to the mounting plate 1, whilst simultaneously relieving the fixing elements 13 of a fixing mechanism 14 attaching the ski 3 to the mounting plate 1 of lateral forces.

In principle, however, it would still be within the scope of the invention if the top face 9 of the ski 3 were designed to other geometric shapes with matching undersides 8 of the mounting plate 1.

The fixing mechanism 14 in the embodiment illustrated as an example here consists of screw connections 15 spaced at a distance apart in the longitudinal direction of the mounting plate 1 and ski 3 and arranged more or less symmetrically relative to the longitudinal central plane 11. In this specific example, four of such screw connections 15 are provided in the region of the longitudinal side faces 16, 17 of the mounting plate 1, arranged in pairs at a toe piece region 18 and a heel piece region 19.

These screw connections 15 are of different structural designs, at least one being designed along the technical principle of a fixed bearing and at least one other along the technical principle of a loose bearing, in order to permit a longitudinal compensation between the mounting plate 1 and the ski 3. It is necessary to provide longitudinal compensation of this type in order to avoid any strain between the mounting plate 1 and the ski 3 and to ensure that the bending behaviour of the ski 3 is not affected in terms of its predetermined and structure-related properties. In the case of the screw connection 15 provided as a fixed bearing, the fixing element 13 is inserted through the mounting plate 1 in the toe piece region 18 in a bore 22 of a diameter 20 adapted to match a screw 21. In the case of the screw connection 15 provided as a loose bearing in the toe piece region, an orifice 23 is provided in the mounting plate 1 for the screw 21 in the form of an elongated hole 24 extending in the longitudinal direction of the mounting plate 1. As is known from the prior art, it would also be possible to enclose the screws 21 in spacer bushes between the top face 4 and a flush surface of a screw head in order to allow longitudinal compensation by a free sliding action.

Provided in the region of the screw connections 15, slot-shaped, inset recesses 25 are provided in the mounting surface 5 of the mounting plate 1, starting from the longitudinal side faces 16, 17 and running in the direction of the longitudinal central plane 11 forming a base surface 26 running parallel with the mounting surface 5, and these are bounded by an end face 27 more or less parallel with the longitudinal central plane 11 and spaced at a distance therefrom. A depth 28 of the recess is smaller than a minimum thickness 29 of the mounting plate 1. Side faces 30 of the recesses 25 run at an angle to a longitudinal central axis 31 of the mounting plate 1 extending in the longitudinal central plane 11. By preference, the end faces 30 of the recesses 25 provided in the toe piece region 18 run from the longitudinal end faces 16, 17 at an incline in the direction of a front end face 32 and the side faces 30 of the recesses 25 in the heel piece region 19 at an incline in the direction of a rear end face 33 of the mounting plate 1, an angle of inclination 34 between the side faces 30 and the longitudinal central axis 31 being less than 90° and preferably within the range of between 50° and 80°. The bores 22 and orifices 23 for the fixing elements 13 are arranged in the region of the base surface 26 of the recesses 25, the central axes 35 of which run perpendicular to the base surface 26, and bevels 36 are provided in the base surface 26 for counter-sinking the screw heads 37 of the screws 21.

The slot-shaped recesses 25 have a T-shaped cross section in a plane running parallel with the longitudinal central plane 11, a width 38 being larger in the region of the base surface 26 than in the region of the mounting surface 5. This results in an undercut, produced on the one hand by the T-shaped cross section of the recess 25 and on the other due to the inclination of the side faces 30 relative to one another.

Insert elements 39 of a height 40 matching the depth 28 of the recess 25 are arranged in the recesses 25 designed in this manner in the form of inset blocks. The insert elements 39 extend from the end faces 27 of the recess 25 in the direction of the longitudinal side faces 16, 17 of the mounting plate 1 and terminate flush therewith. Projecting beyond the side faces 41, 42 and an end face 43 directed towards the longitudinal central plane 11 is a strip-shaped extension 44 matching the T-shaped cross section of the recess 25. As a result of the angle of inclination 34, a length 45 of the side faces 41, 42 is longer than a distance 46 of the end face 27 of the recess 25 from the longitudinal side face 16, 17 of the mounting plate 1 measured perpendicular to the longitudinal central axis 32. The distance 46 is approximately one quarter to one third of a total width 47 of the mounting plate 1, the total width 47 being slightly smaller than or the same as a width 48 of the runner 2 or ski 3 in the region in which the mounting plate 1 is mounted.

The thickness 29 of the mounting plate 1 is approximately between 15 mm and 30 mm, in particular 22 mm. The depth 28 of the recess 25, which corresponds to the height 40 of the insert element 39, is approximately between 8 mm and 12 mm, in particular 10 mm.

As can be seen more clearly from FIG. 3, the mounting plate 1 together with the insert elements 39 is designed so as to form a continuous mounting surface 5. Accordingly, it is irrelevant in which regions of the mounting plate 1 the fixing screws 49 used to secure the ski binding 6, e.g. toe piece, depending on the type of ski binding 6 used, are anchored. The height 40 of the insert elements 39 is slightly larger than an insertion depth 50 of the fixing screw 49 needed to produce a secure anchor. In any event, the insertion depth 50 is determined on the basis of the extraction force that would be needed and therefore depends on the type of thread provided on the fixing screw 49 and the strength of the material used for the insert elements 39. The same conditions apply to fixing screws 49 anchored directly in the mounting plate 1. By preference, the mounting plate 1 and the insert elements 39 are made from a high-strength plastics material, e.g. fibre-reinforced polyamide, although this is not a specific requirement and any other material may also be used.

During travel, when the runner 2 bends as a result of strain on the ski binding 6 due to the tensed boot as it passes over a bump in the ground, reaction forces are transmitted to the fixing screws 49, directed towards the opposite ends of the runner 2. If fixing screws 49 are anchored in insert elements 39, depending on the type of ski binding 6, the latter will determine the force components guided in the direction of the longitudinal central axis 31, due to the direction in which the side faces 30 are inclined relative to the longitudinal central axis 31, thereby ensuring that the ski binding 6 is perfectly centred. Under no circumstances can there be any uncontrolled sliding movement of the insert elements 39 in the direction of the longitudinal side faces 16, 17 of the mounting plate 1.

A perfect anchoring of the ski binding 6 on the mounting plate 1 is obtained if, when mounting the ski binding 6 depending on its type, the bores are arranged so that one or more of the fixing screws 49 is or are anchored in the insert element 39 in the region of the side faces 41, 42 of the insert elements 25, i.e. a part of the screw thread, and the other part in the main body of the mounting plate 1.

Figure 4:
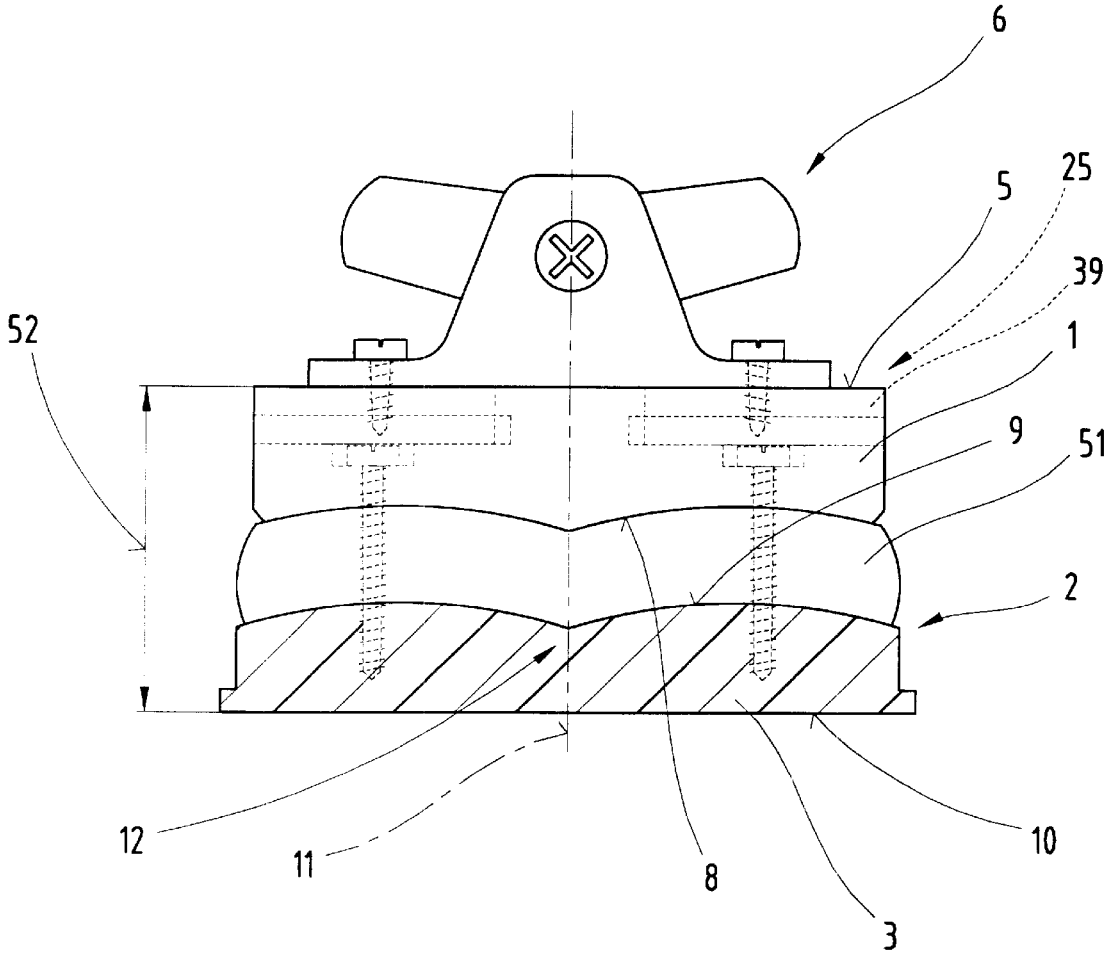
FIG. 4 illustrates another embodiment of the mounting plate proposed by the invention on a runner, seen in partial section from a front view.

FIG. 4 illustrates another embodiment of the mounting plate 1 proposed by the invention, secured to a runner 2, in particular a ski 3. The top face 9 of the ski 3 is three-dimensionally shaped and is provided, for example, with the recess 12 extending in the direction of the longitudinal central plane 11. The mounting surface 5 of the mounting plate 1 is of a more or less flat planar design across an entire and, moreover, standard mounting region so that it can be fitted with any commercially available ski binding 6 known from the prior art. As described in relation to the embodiments above, the mounting plate 1 also has recesses 25 with insert elements 39 extending out from the mounting surface 5. In the embodiment illustrated as an example here, an intermediate section 51 is arranged between the runner 2 and the mounting plate 1. It has a contour adapted to conform to the shape of the top face 9 of the ski 3 and the underside 8 of the mounting plate 1, i.e. the intermediate section 51 is of a matching design and can therefore optionally be used to increase the distance 52 between the gliding surface 10 and the mounting surface 5, a positive fit being obtained between the mounting plate 1, the intermediate section 51 and the runner 2. Consequently, a mounting plate 1 of standard specifications can be used and a distance 52 selected by using intermediate sections 51 of different thicknesses.

The intermediate section 51 may also be made from a different material than the material used to make the mounting plate 1, e.g. this intermediate section 51 can be used as a means of providing a shock-absorbing effect. There is no need to provide a separate mechanism for securing the intermediate section 51 to the runner 2 since the latter can be screwed together with the mounting plate 1 by means of the fixing mechanisms 14 already provided therein.

Finally, for the sake of good order, it should be pointed out that in order to provide a clearer understanding of the structure of the mounting plate 1, it and its constituent components have been illustrated to a certain extent out of proportion and/or on an enlarged scale and/or on a reduced scale.

The task underlying the independent solutions proposed by the invention can be taken from the description.

Above all, the individual embodiments illustrated in FIGS. 1, 2, 3; 4 may be construed as objet representing independent solutions proposed by the invention. The tasks and solutions relating to them may be taken from the detailed description of these drawings.

What is claimed is:

1. A mounting plate for a runner having a top face, the mounting plate extending in a longitudinal direction and having longitudinally extending side faces, a longitudinally extending central axis and a mounting surface for a coupling mechanism, the mounting plate comprising fixing mechanisms spaced apart from each other in the longitudinal direction for affixing the mounting plate to the top face of the runner, the mounting surface having recesses in the region of the fixing mechanisms and receiving insert elements for fixing screws for affixing the coupling mechanism to the mounting surface of the mounting plate, the fixing mechanism being arranged at the base of the recesses, and the recesses extending from the longitudinally extending side faces of the mounting plate towards the longitudinally extending central axis of the mounting plate and having side faces extending at an angle of inclination relative to the longitudinally extending central axis, the angles of inclination in a toe piece region and a heel piece region of the runner being directed towards each other and being smaller than 90°.

2. Mounting plate as claimed in claim 1, wherein a cross section of the recess in a plane containing the longitudinally extending side faces has a T-slot shape.

3. Mounting plate as claimed in claim 1, wherein the insert elements are inset blocks.

4. Mounting plate as claimed in claim 1, wherein a base surface of the recess runs in a plane extending substantially parallel with the mounting surface.

5. Mounting plate as claimed in claim 1, wherein end faces of the recess facing one another are spaced at a distance apart from one another.

6. Mounting plate as claimed in claim 1, wherein a depth of the recess is smaller than a minimum thickness of the mounting plate.

7. Mounting plate as claimed in claim 1, wherein bores and orifices are provided through the mounting plate in the region of the recesses, crossing from the base surface in the direction towards an underside in order to receive fixing elements of the fixing mechanisms.

8. Mounting plate as claimed in claim 1, wherein the fixing mechanisms for the mounting plate form at least one fixed bearing and one loose bearing arrangement in the direction of the longitudinal extension of the mounting plate.

9. Mounting plate as claimed in claim 1, wherein the recesses are arranged symmetrically opposite one another relative to the longitudinally extending central axis.

10. Mounting plate as claimed in claim 1, wherein a height of the insert elements is approximately the same as the depth of the recess.

11. Mounting plate as claimed in claim 1, wherein a width of the insert elements is larger at a base surface than at the mounting surface.

12. Mounting plate as claimed in claim 1, wherein an underside of the mounting plate is shaped to match the contour of the top face of the runner.

13. Mounting plate as claimed in claim 1, wherein a plate-shaped intermediate section is arranged between the runner and the mounting plate.

14. Mounting plate as claimed in claim 13, wherein the intermediate section is made from a high-strength plastics material.

15. Mounting plate as claimed in claim 13, wherein the intermediate section is made from a shock-absorbing plastics material.

16. Mounting plate as claimed in claim 1, wherein the mounting plate and the insert elements are made from a high-strength plastics material.

17. Runner, wherein a mounting plate as claimed in claim 1 attached to the top face of the runner in a mounting region for a coupling mechanism.

18. Runner as claimed in claim 17, wherein the mounting plate is attached to the top face of the runner by means of an intermediate section.

19. Mounting plate as claimed in claim 1, wherein the runner is a ski.

20. Mounting plate as claimed in claim 19, wherein the coupling mechanism is a ski binding for detachably holding a shoe.

* * * * *